US007063279B2

(12) United States Patent
Mizuno et al.

(10) Patent No.: US 7,063,279 B2
(45) Date of Patent: Jun. 20, 2006

(54) FUEL INJECTION VALVE

(75) Inventors: Shingo Mizuno, Okazaki (JP); Toyoji Nishiwaki, Anjo (JP); Yoshitomo Oguma, Hekinan (JP)

(73) Assignee: Denso Corporation, Kariya (JP)

( * ) Notice: Subject to any disclaimer, the term of this patent is extended or adjusted under 35 U.S.C. 154(b) by 1 day.

(21) Appl. No.: 11/038,216

(22) Filed: Jan. 21, 2005

(65) Prior Publication Data

US 2005/0161537 A1 Jul. 28, 2005

(30) Foreign Application Priority Data

Jan. 22, 2004 (JP) ..... 2004-014807
Nov. 10, 2004 (JP) ..... 2004-326253

(51) Int. Cl.
*B05B 1/30* (2006.01)

(52) U.S. Cl. ..... 239/585.1; 239/585.4; 239/585.5; 239/600; 239/DIG. 12

(58) Field of Classification Search ..... 239/585.1, 239/585.4, 585.5, 600, DIG. 12; 123/294, 123/296

See application file for complete search history.

(56) References Cited

U.S. PATENT DOCUMENTS

| | | | | |
|---|---|---|---|---|
| 5,944,262 | A * | 8/1999 | Akutagawa et al. | 239/585.4 |
| 5,996,910 | A * | 12/1999 | Takeda et al. | 239/585.1 |
| 6,024,302 | A | 2/2000 | Shumida et al. | |
| 6,412,713 | B1 * | 7/2002 | Okajima et al. | 239/585.1 |
| 6,769,638 | B1 * | 8/2004 | Munezane et al. | 239/585.1 |
| 6,976,643 | B1 * | 12/2005 | Hokao | 239/585.1 |
| 6,994,279 | B1 * | 2/2006 | Saito et al. | 239/585.1 |

* cited by examiner

*Primary Examiner*—Steven J. Ganey
(74) *Attorney, Agent, or Firm*—Nixon & Vanderhye P.C.

(57) ABSTRACT

A fuel injection valve comprises a body, a valve member, a coil, a movable core, a fixed core, and a housing member. The body has a nozzle hole. The valve member allows injection of fuel from the nozzle hole. The coil generates a magnetic field. The movable core axially reciprocates with the valve member. The fixed core is provided adjacent to a side of the movable core that is opposite the nozzle hole. The fixed core attracts the movable core and moves with the valve member due to the magnetic field generated from the coil. The housing member has a first axial end fixed to the body. The housing member covers the coil and forms a magnetic circuit together with the body, the movable core, and the fixed core due to the magnetic field generated by the coil.

7 Claims, 5 Drawing Sheets

FUEL INJECTION VALVE

CROSS REFERENCE TO RELATED APPLICATIONS

This application is based upon and claims the benefit of priority of Japanese Patent Application No. 2004-014807, filed on Jan. 22, 2004 and Japanese Patent Application No. 2004-326253, filed on Nov. 10, 2004, the contents of which are incorporated herein by reference.

FIELD OF THE INVENTION

The present invention relates to a fuel injection valve for injecting fuel into an internal combustion engine.

BACKGROUND OF THE INVENTION

A fuel injection valve, which uses a magnetic attractive force generated by energization of a coil to drive a valve member, is conventionally known. Such a fuel injection valve includes a plurality of magnetic members to form a magnetic circuit, as is described in Japanese Patent Laid-Open Publication No. Hei 10-47199. In the case of a fuel injection valve disclosed in this publication, a core, an armature, and a housing, which surround a coil, form a magnetic circuit. In such a structure, a magnetic attractive force is generated between the core and the armature to drive a valve body.

If a fuel injection valve is applied to a direct injection type engine as in the case of the fuel injection valve disclosed in the above-cited publication, the fuel injection valve is mounted on a cylinder head of the engine. In this case, since the fuel injection valve is fixed to the cylinder head, a load in an axial direction is applied to the fuel injection valve. A plurality of magnetic members forming a magnetic circuit in an injector are respectively fixed to other members by welding or the like. Therefore, if a load is applied to one of the magnetic members, there is a possibility that the magnetic member fixed to the magnetic member under the load may also be deformed.

In order to ensure the fuel injection characteristic of the fuel injection valve, it is necessary to precisely control a distance between a fixed core and a movable core such as an armature, that is, the amount of lift of the valve member. However, if a load is applied to the fuel injection valve as described above, there is a possibility that each of the magnetic member of the fuel injection valve may be deformed. Accordingly, even if the distance between the fixed core and the movable core is precisely controlled when the fuel injection valve is mounted, the distance between the fixed core and the movable core is changed by the load applied to the fuel injection valve when the fuel injection valve is provided on the engine. As a result, there arises a problem that the fuel injection characteristic of the fuel injection valve changes when the fuel injection valve is mounted on the engine.

SUMMARY OF THE INVENTION

In view of the above problem, the present invention has an object of providing a fuel injection valve with a reduced change in fuel injection characteristic when the fuel injection valve is mounted on an engine.

One aspect of the present invention provides a housing member forming a magnetic circuit has an end on the side opposite to a body, the end being relatively movable in an axial direction with respect to a fixed core. For example, like a load pushing toward a nozzle hole, if a load in the axial direction is applied to the housing member, the housing member is deformed by the load. On the other hand, the housing member is relatively movable in the axial direction with respect to the fixed core. Accordingly, even if the housing member is deformed, the fixed core is not deformed. As a result, the distance between a movable core and the fixed core remains unchanged. Therefore, even if a load in the axial direction is applied when the fuel injection valve is mounted on the engine, a change in fuel injection characteristic can be reduced.

In another aspect of the present invention, the position where the housing member and a cylindrical member are opposed to each other and the position where the movable core and the fixed core are in contact with each other are shifted from each other in the axial direction. Therefore, a change in distance between the movable core and the fixed core, which is generated with the deformation of the housing member, is reduced. Thus, a change in fuel injection characteristic can be reduced even if a load in the axial direction is applied when the fuel injection valve is mounted on the engine.

In another aspect of the present invention, the movable core and the fixed core are housed within the cylindrical member. An end of the housing member, which is opposite to the body, is relatively movable in the axial direction with respect to the cylindrical member. Thus, even if a load in the axial direction is applied to the housing member, the cylindrical member housing the movable core and the fixed core therein is not deformed, leaving the distance between the movable core and the fixed core unchanged. Accordingly, even if a load in the axial direction is applied when the fuel injection valve is mounted on the engine, a change in fuel injection characteristic can be reduced.

In yet another aspect of the present invention, a connector portion for connecting a coil with a power source is provided. The housing member is cylindrical and has an opening into which the connector portion can be inserted. Therefore, the housing member can be easily attached.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

Hereinafter, a plurality of preferred embodiments of the present invention will be described with reference to the accompanying drawings.

Figure 1:
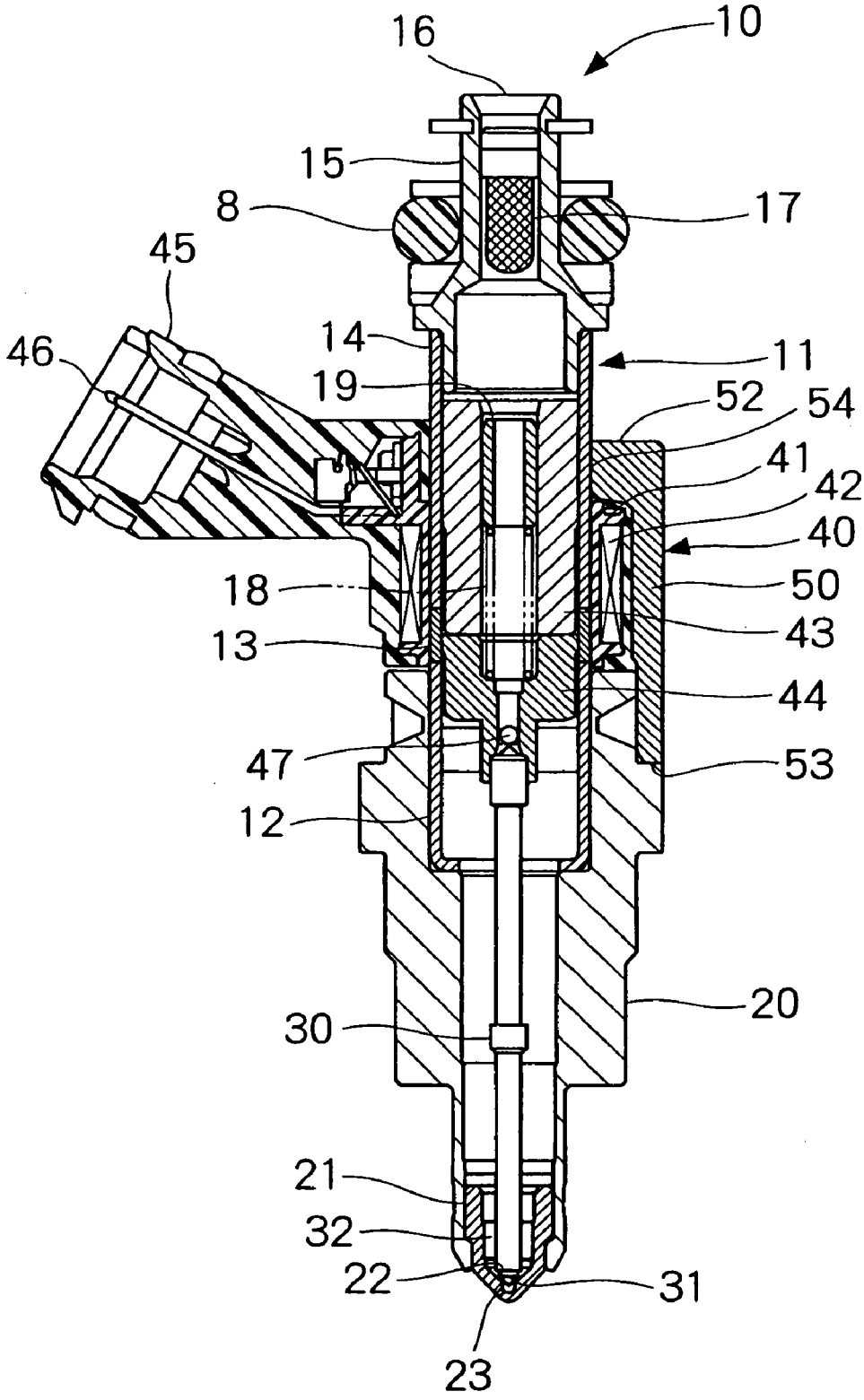
FIG. 1 is a cross-sectional view of a fuel injector according to a first embodiment of the present invention.
Figure 2:
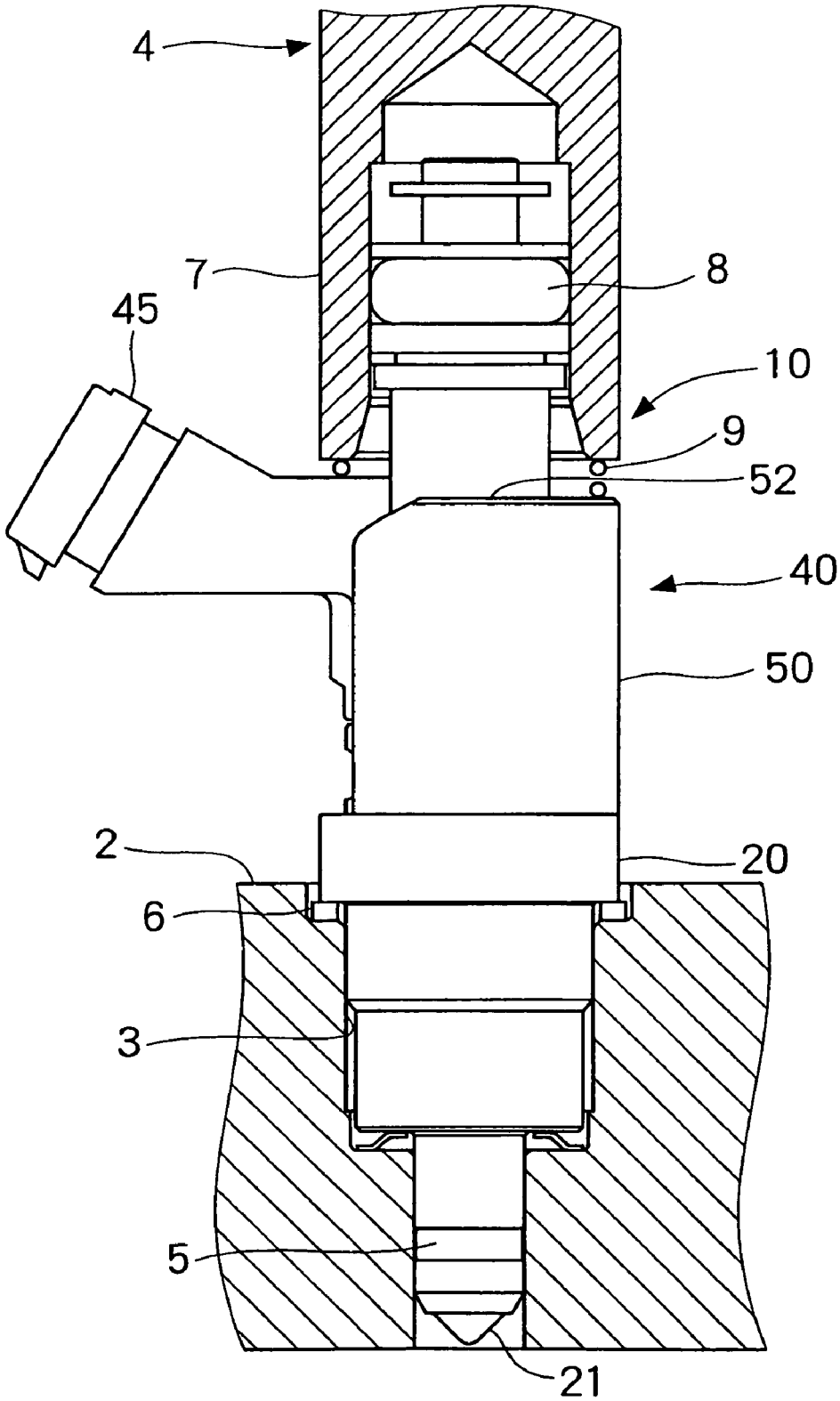
FIG. 2 is a side view of the fuel injector of FIG. 1 mounted in a cylinder head of a gasoline engine.

A fuel injection valve (hereinafter, referred to as an injector) according to a first embodiment of the present invention is shown in FIG. 1. An injector 10 according to this embodiment is used for a direct injection type gasoline engine. The injector 10 may be used not only for a direct injection type gasoline engine but also for a premix combustion type gasoline engine or a diesel engine. If the injector 10 is used for a direct injection type gasoline engine, the injector 10 is mounted on a cylinder head 2 of the engine as shown in FIG. 2. The injector 10 is fit into a bore 3 formed in the cylinder head 2. The bore 3 opens into a combustion chamber of the engine.

One end of the injector 10 is inserted into the bore 3, whereas the other end is connected to a fuel rail 4 for supplying fuel. Seal members 5 and 6 are provided between the cylinder head 2 and the injector 10. The seal members 5 and 6 serve to prevent the leakage of sucked air and a combustion gas from the combustion chamber. The end of the injector 10, which is on the side opposite to the cylinder head 2, is inserted into an attachment portion 7 of the fuel rail 4. A space between the injector 10 and the attachment portion 7 of the fuel rail 4 is sealed by a sealing member 8. The sealing member 8 serves to prevent the leakage of fuel from the fuel rail 4.

An elastic member 9 is provided between the attachment portion 7 of the fuel rail 4 and the injector 10. The elastic member 9 is, for example, a spring or the like, which pushes the injector 10 against the cylinder head 2. As a result, even if the injector 10 has a dimensional variation, the dimensional variation is absorbed by the expansion and contraction of the elastic member 9. As a result, the injector 10 is surely and firmly fixed to the cylinder head 2. The attachment portion 7 of the fuel rail 4 may be screwed into the bore 3 so as to directly push the injector 10 against the cylinder head 2 to fix the injector 10 thereto.

As shown in FIG. 1, a cylindrical member 11 of the injector 10 is formed in an approximately cylindrical shape. The cylindrical member 11 includes a first magnetic portion 12, a non-magnetic portion 13, and a second magnetic portion 14. The non-magnetic portion 13 prevents a magnetic short circuit from occurring between the first magnetic portion 12 and the second magnetic portion 14. The first magnetic portion 12, the non-magnetic portion 13, and the second magnetic portion 14 are connected into one, for example, by laser welding or the like. Alternatively, the cylindrical member 11 may be made of a magnetic material as one cylindrical body. A portion of the cylindrical member 11, which corresponds to the non-magnetic portion 13, may be non-magnetized by thermal processing.

An inlet member 15 is provided at one axial end of the cylindrical member 11. The inlet member 15 is pressed into the cylindrical member 11 on its inner circumferential side. The inlet member 15 has a fuel inlet 16. The fuel inlet 16 is connected to the fuel rail 4, to which fuel is supplied from a fuel pump (not shown). The fuel supplied from the fuel rail 4 to the fuel inlet 16 flows through a fuel filter 17 into the cylindrical member 11 on its inner circumferential side. The fuel filter 17 serves to remove foreign matters contained in the fuel.

A holder 20 is provided at the other end of the cylindrical member 11. The holder 20 is formed in a cylindrical shape. A nozzle body 21 is located in the holder 20. The nozzle body 21 is formed in a cylindrical shape and is fixed to the holder 20 by, for example, pressing, welding, or the like. The holder 20 and the nozzle body 21 in this embodiment constitute a body recited in the appended claims. The holder 20 and the nozzle body 21 may be formed as an integral member. The nozzle body 21 has a valve seat 22 on a conical inner wall having a decreasing inner diameter toward the tip. The nozzle body 21 has a nozzle hole 23 formed therethrough in the vicinity of the end on the side opposite the housing. The nozzle hole 23 connects the inner wall and the outer wall with each other.

A needle 30 serving as a valve member is housed within the cylindrical member 11, the holder 20, and the nozzle body 21 on their inner circumferential side so as to be capable of axially reciprocating. The needle 30 is located on generally the same axis as the nozzle body 21. The needle 30 has a contact portion 31 capable of coming into contact with the valve seat 22 of the nozzle body 31. The needle 30 and the nozzle body 21 form a fuel passage 32 therebetween, through which fuel flows.

The injector 10 has a driving portion 40 for driving the needle 30. The driving portion 40 includes a spool 41, a coil 42, a fixed core 43, a movable core 44, and a housing member 50. The spool 41 is located on the outer circumferential side of the cylindrical member 11. The spool 41 is made of a resin in a cylindrical shape. The coil 42 is wound around the outer circumferential side of the spool 41. The coil 42 is connected to a terminal 46 of a connector portion 45. The fixed core 43 is provided on the inner circumferential side of the coil 42 through the cylindrical member 11. The fixed core 43 is made of a magnetic material, for example, iron or the like in a cylindrical shape, and is fixed to the cylindrical member 11 on its inner circumferential side by, for example, pressing.

The movable core 44 is housed within the cylindrical member 11 on its inner circumferential side so as to be capable of axially reciprocating. The movable core 44 is made of a magnetic material, for example, iron or the like in a cylindrical shape. The movable core 44 is in contact with a spring 18 serving to bias the end on the fixed core 43 side. One end of the spring 18 is in contact with the movable core 44, whereas the other end is in contact with an adjusting pipe 19. The adjusting pipe 19 is pressed into the fixed core 43. The regulation of the amount of pressing of the adjusting pipe 19 allows the load onto the spring 18 to be regulated. The spring 18 has a force for extending in the axial direction. Therefore, the needle 30 and the movable core 44 are pushed by the spring 18 in such a direction that the contact portion 31 comes to rest on the valve seat 22.

When the coil 42 is not energized, the movable core 44 and the needle 30 are pushed toward the valve seat 22 so that the contact portion 31 rests on the valve seat 22. In an unenergized state of the coil 42, a predetermined gap is formed between the fixed core 43 and the movable core 44. Upon energization of the coil 42, the movable core 44 is attracted toward the fixed core 43 while the opposing faces of the fixed core 43 and the movable core 44 come into contact with each other. As a result, the amount of movement of the movable core 44 and the needle 30 moving cooperatively with the movable core 44 is restrained. Specifically, the distance between the fixed core 43 and the movable core 44 in the unenergized state of the coil 42 corresponds with the amount of lift of the needle 30. Therefore, the distance between the fixed core 43 and the movable core 44 is precisely controlled.

Figure 3:
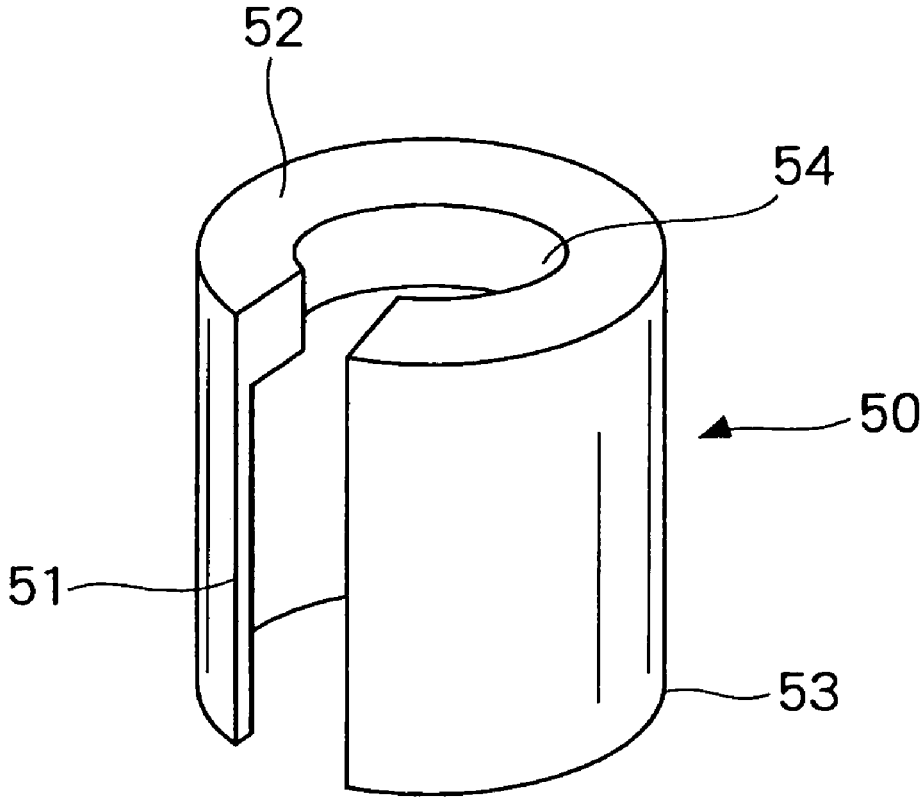
FIG. 3 is a perspective view of a housing member of the fuel injector of FIG. 1.

The housing member 50 is made of a magnetic material, for example, iron or the like, and covers the outer circumferential side of the coil 42. The housing member 50 is formed in an approximately cylindrical shape, as shown in FIG. 3. The housing member 50 has an axially extending opening 51. The connector portion 45 can be inserted into the opening 51. The housing member 50 has, on the side opposite to the nozzle hole, a seat portion 52 projecting inwardly in a radial direction. When the injector 10 is mounted on the engine, one end of the elastic member 9 provided between the attachment portion 7 of the fuel rail 4 and the injector 10, as shown in FIG. 2, comes into contact with the seat portion 52 of the housing member 50.

As shown in FIG. 1, one end of the housing member 50 in the axial direction, that is, an end 53 on the holder 20 side is in contact with the holder 20. The housing member 50 and the holder 20 are fixed to each other, for example, by welding or the like. The housing member 50 and the holder 20 may be fixed not only by welding, but also by other methods such as pressing, fitting, brazing, and caulking.

The other end of the housing member 50, that is, an end 54 on the side opposite to the holder 20, is relatively movable in the axial direction with respect to the cylindrical member 11. Specifically, the inner circumferential face of the seat portion 52 provided for the end 54 of the housing member 50 on the side opposite to the holder 20 is not fixed to the outer circumferential face of the cylindrical member 11. The housing member 50 and the cylindrical member 11 are in contact with each other or form a small gap therebetween. The distance between the housing member 50 and the cylindrical member 11 is set so as not to inhibit the flow of a magnetic flux. Specifically, it is desirable that the housing member 50 and the cylindrical member 11 be not in contact with each other so as not to inhibit the flow of the magnetic flux. Since the housing member 50 and the cylindrical member 11 are not fixed to each other, the deformation of the housing member 50 is not transferred to the cylindrical member 11 even if the housing member 50 is deformed in the axial direction. The position where the end 54 of the housing member 50 on the side opposite to the holder 20 and the cylindrical member 11 are opposed to each other is shifted from the position where the fixed core 43 and the movable core 44 form a gap in the axial direction of the injector 10.

Figure 4:
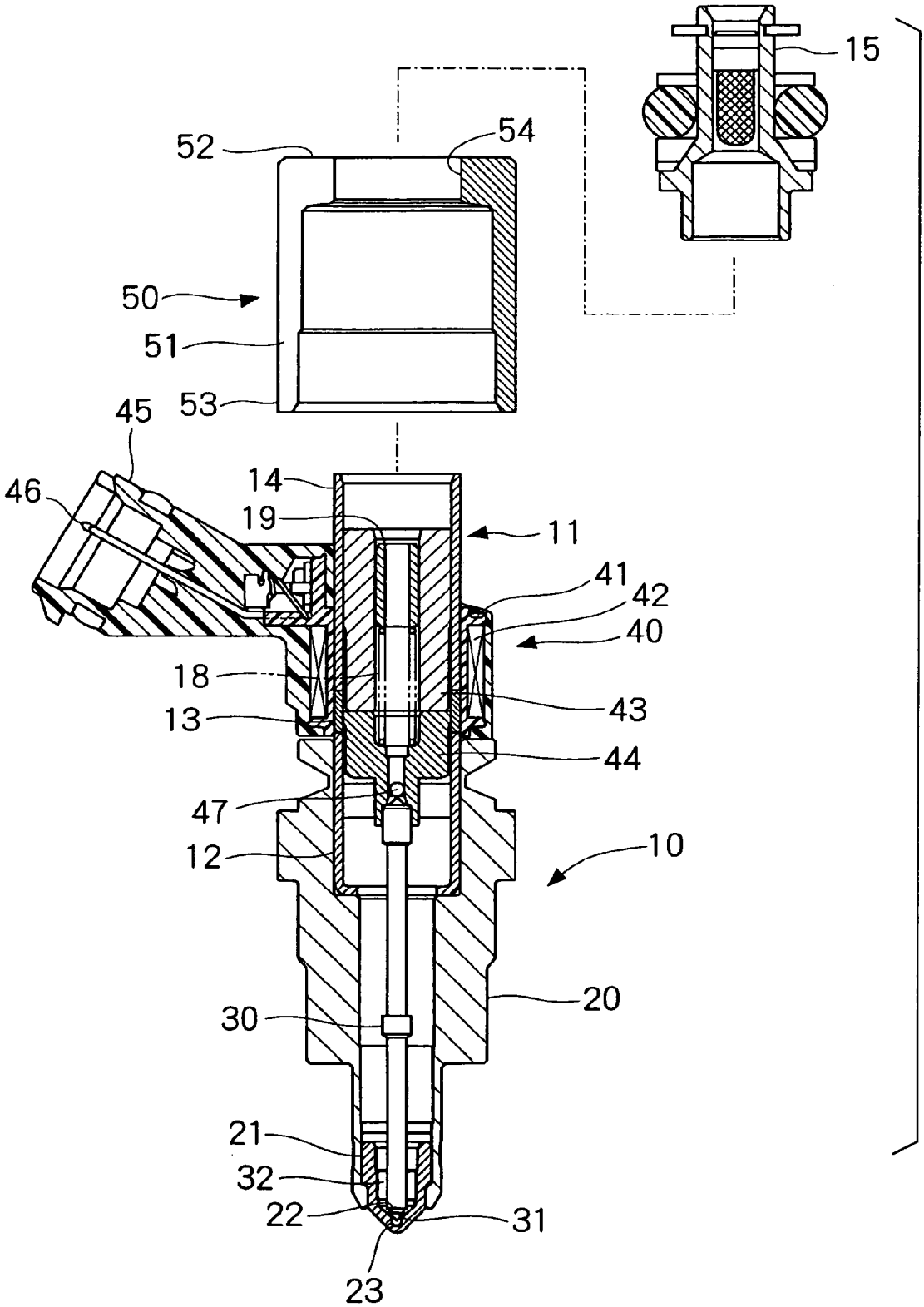
FIG. 4 is a partially exploded cross-sectional view of the fuel injector of FIG. 1.

The housing member 50 is provided from the side of the cylindrical member 11, which is opposite to the nozzle hole 23, on the outer side of the cylindrical member 11 and the coil 42 in the radial direction as shown in FIG. 4. Since the opening 51 is formed at the position corresponding to the connector portion 45, the housing member 50 is inserted toward the nozzle hole 23 beyond the connector portion 45. The end 53 of the inserted housing member 50 on the holder 20 side is welded with the holder 20 so as to be fixed to the holder 20. After the attachment of the housing member 50, the inlet member 15, which is independent of the cylindrical member 11, is attached to the cylindrical member 11, thereby achieving the assembly of the injector 10.

The assembled injector 10 is mounted on the cylinder head 2 of the engine, as shown in FIG. 2. The end of the injector 10 on the nozzle hole 23 side is inserted into the bore 3 of the cylinder head 2, whereas the other end on the side opposite to the nozzle hole 23 is inserted into the attachment portion 7 of the fuel rail 4. At that time, the elastic member 9 is provided between the attachment portion 7 and the injector 10. As a result, the injector 10 is held onto the cylinder head 2 by the pushing force of the elastic member 9.

As described above, when the injector 10 is mounted on the engine, the injector 10 is pushed against the cylinder head 2 by the elastic member 9. At that time, the end of elastic member 9 on the side opposite to the fuel rail 4 is in contact with the housing member 50 of the injector 10. Therefore, a compressive load in the axial direction is applied to the housing member 50. When the load in the axial direction is applied to the housing member 50, the housing member 50 is deformed, reducing its total length in the axial direction.

On the other hand, the end 54 of the housing member 50 on the side opposite to the holder 20 is not fixed to the cylindrical member 11. Therefore, the housing member 50 is relatively movable in the axial direction with respect to the cylindrical member 11. As a result, if the housing member 50 is deformed by the load in the axial direction, the deformation of the housing member 50 does not affect the cylindrical member 11. Specifically, the cylindrical member 11 is never deformed with the deformation of the housing member 50. As a result, the distance between the fixed core 43 and the movable core 44 housed within the cylindrical member 11 is not changed by the deformation of the housing member 50.

Next, the operation of the injector 10 having the above-described structure will be described.

When the energization of the coil 42 is stopped, no magnetic attractive force is generated between the fixed core 43 and the movable core 44. Therefore, the movable core 44 and the needle 30 cooperatively move in a direction opposite to the fixed core 43 by a pressing force of the spring 18. As a result, when the energization of the coil 42 is stopped, the contact portion 31 of the needle 30 rests on the valve seat 22. Accordingly, the fuel is not injected from the injection hole 23.

When the coil 42 is energized, a magnetic flux flows through the housing member 50, the first magnetic portion 12, the movable core 44, the fixed core 43, and the second magnetic portion 14 by a magnetic field generated from the coil 42 to form a magnetic circuit. As a result, a magnetic attractive force is generated between the fixed core 43 and the movable core 44. If the magnetic attractive force generated between the fixed core 43 and the movable core 44 becomes larger than the pressing force of the spring 18, the movable core 44 moves toward the fixed core 43. As a result, the contact portion 31 of the needle 30 leaves the valve seat 22.

The fuel flowing from the fuel inlet 16 into the injector 10 flows through the fuel filter 17, an inner circumferential side of the inlet member 15, an inner circumferential side of the adjusting pipe 19, an inner circumferential side of the movable core 44, a fuel hole 47 formed through the movable core 44, and an inner circumferential side of the holder 20 into the fuel passage 32. The fuel flowing into the fuel passage 32 flows between the needle 30 separating from the valve seat 22 and the nozzle body 21 into the nozzle hole 23. As a result, the fuel is injected from the nozzle hole 23.

When the energization of the coil 42 is stopped, the magnetic attractive force between the fixed core 43 and the movable core 44 disappears. As a result, the movable core 44 and the needle 30 move in the direction opposite to the fixed core 43 by the pressing force of the spring 18. Therefore, the contact portion 31 of the needle 30 comes to rest on the valve seats 22 again to block the fuel flow between the fuel passage 32 and the nozzle hole 23. Therefore, the injection of the fuel is terminated.

As described above, in the first embodiment of the present invention, the housing member 50 forming the magnetic circuit has the end 54 on the side opposite to the holder 20, which is capable of reciprocating in the axial direction reltive to the cylindrical member 11. Therefore, even if a load in the axial direction is applied to the housing member 50 when the injector 10 is mounted on the engine, the deformation of the housing member 50 due to the load is not transferred to the cylindrical member 11. As a result, a change in distance between the fixed core 43 and the movable core 44, which is generated between, before, and after the mounting of the injector 10 on the engine, can be reduced. Thus, a change in fuel injection characteristic of the injector 10 can be reduced.

Figure 5:
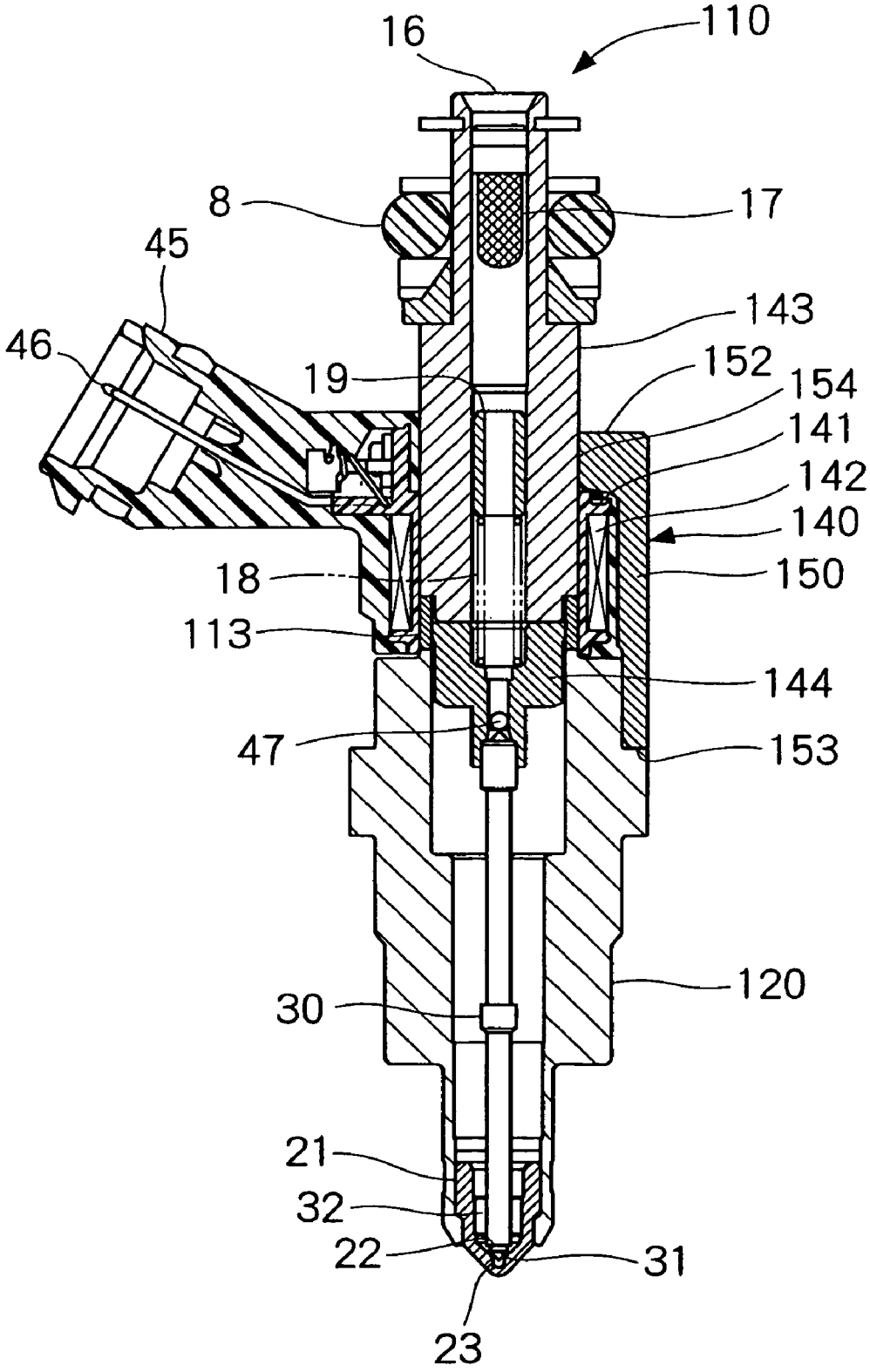
FIG. 5 is a cross-sectional view a fuel injector according to a second embodiment of the present invention.

An injector according to a second embodiment of the present invention is shown in FIG. 5. Substantially the same components as those of the first embodiment are denoted by the same reference numerals and the description thereof is herein omitted.

An injector 110 according to the second embodiment does not include a member corresponding to the cylindrical member 11 of the injector 10 according to the first embodiment shown in FIG. 1. The injector 110 according to the second embodiment includes an approximately cylindrical fixed core 143. The fixed core 143 is integrally formed of a magnetic material. One end of the fixed core 143 in the axial direction has the fuel inlet 16. The fuel filter 17 is provided near the fuel inlet 16. Specifically, in the second embodiment, the fixed core 143 and the inlet member are integrally formed.

A holder 120 is provided for the other end of the fixed core 143. As in the first embodiment, the nozzle body 21 is provided in the holder 120. The holder 120 and the nozzle body 21 constitute a body recited in the appended claims. The nozzle body 21 has a valve seat 22 and a nozzle hole 23. A non-magnetic pipe 113 is provided between the fixed core 143 and the holder 120. The non-magnetic pipe 113 prevents a magnetic short circuit from occurring between the fixed core 143 and the holder 120. The fixed core 143 or the holder 120 and the non-magnetic pipe 113 are connected to each other by, for example, welding or the like.

The needle 30 serving as a valve member is capable of reciprocating in the axial direction on the inner circumferential side of the holder 120 and the nozzle body 21. The needle 30 is located on generally the same axis as the nozzle body 21. The needle 30 has a contact portion 31 capable of coming into contact with the valve seat 22 of the nozzle body 21. The needle 30 and the nozzle body 21 form the fuel passage 32 therebetween.

A driving portion 140 includes a spool 141, a coil 142, a movable core 144, and a housing member 150. The above-described fixed core 143 is also included in the driving portion 140. The spool 141 is located on the outer circumferential side of the fixed core 143. The coil 142 is wound around the outer circumferential side of the spool 141. Specifically, the spool 141 is in direct contact with the fixed core 143. The coil 142 is connected to a terminal 46 of a connector portion 45. The movable core 144 is housed within the fixed core 143 on its inner circumferential side so as to be capable of reciprocating in the axial direction. The movable core 144 is in contact with a spring 18 at its end on the fixed core 143 side. One end of the spring 18 is in contact with the movable core 144, whereas the other end is in contact with an adjusting pipe 19. The adjusting pipe 19 is pressed into the fixed core 143.

The housing member 150 is made of a magnetic material, for example, iron or the like, and covers an outer circumferential side of the coil 142. The housing member 150 is formed in an approximately cylindrical shape. The housing member 150 has an axially extending opening (not shown) in a part thereof in a circumferential direction. The connector portion 45 can be inserted into the opening. The housing member 150 has, on the side opposite to the nozzle hole 23, a seat portion 152 projecting inwardly in a radial direction. When the injector 110 is mounted on the engine, one end of the elastic member 9 comes into contact with the seat portion 152.

One end of the housing member 150 in the axial direction, that is, an end 153 on the holder 120 side is in contact with the holder 120. The housing member 150 and the holder 120 are fixed to each other, for example, by welding or the like. A method of fixing the housing member 150 and the holder 120 is not limited to welding.

The other end of the housing member 150, that is, an end 154 on the side opposite to the holder 120, is movable in the axial direction relative to the fixed core 143. Specifically, the inner circumferential face of the seat portion 152 provided on the end 154 of the housing member 150 on the side opposite to the holder 120 is not fixed to the outer circumferential face of the fixed core 143. The housing member 150 and the fixed core 143 are in contact with each other or form a small gap therebetween. The distance between the housing member 150 and the fixed core 143 is set so as not to inhibit the flow of a magnetic flux. Specifically, it is desirable that the housing member 150 and the fixed core 143 be not in contact with each other so as not to inhibit the flow of the magnetic flux. Since the housing member 150 and the fixed core 143 are not fixed to each other, the deformation of the housing 150 is not transferred to the fixed core 143 even if the housing member 150 is deformed in the axial direction. The position where the end 154 of the housing member 150 on the side opposite to the holder 120 and the fixed core 143 are opposed to each other is shifted from the position where the fixed core 143 and the movable core 144 form a gap in the axial direction of the injector 110.

In the second embodiment, the movable core 144 and the needle 30 are directly provided within the fixed core 143, the non-magnetic pipe 113, and the holder 120. Therefore, a separate member for housing the fixed core 143, the movable core 144, and the needle 30 therein, for example, a cylindrical member is not required. Thus, the number of components can be reduced.

Moreover, in the second embodiment, the end 154 of the housing member 150, which is opposite to the holder 120, is capable of moving in the axial direction relative to the fixed core 143. Therefore, even if a load in the axial direction is applied to the housing member 150 when the injector 110 is mounted on the engine, the deformation of the housing member 150 is not transferred to the fixed core 143. As a result, a change in distance between the fixed core 143 and the movable core 144, which is generated between before and after the mounting of the injector 110 on the engine, can be reduced. Thus, a change in fuel injection characteristic of the injector 110 can be reduced.

What is claimed is:

1. A fuel injection valve comprising:

a body having a nozzle hole;

a valve member for selectively enabling fuel to inject through the nozzle hole;

a coil for generating a magnetic field;

a movable core axially reciprocating with the valve member;

a fixed core provided adjacent to a side of the movable core that is opposite to the nozzle hole, the fixed core and the movable core being attracted to each other and moving with the valve member due to the magnetic field generated from the coil; and a housing member having a first end fixed to the body and a second end axially movable relative to the fixed core, the housing member covering the coil and forming a magnetic circuit together with the body, the movable core, and the fixed core upon the magnetic field being generated by the coil.

2. The fuel injection valve according to claim 1, wherein the second end of the housing member and a position where the movable core and the fixed core contact each other are axially displaced from each other.

3. The fuel injection valve according to claim 1, further comprising a cylindrical member housing the movable core and the fixed core therein, wherein the second end of the housing member is movable in the axial direction relative to the cylindrical member.

4. The fuel injection valve according to claim 1, further comprising a connector portion for connecting the coil with a power source, wherein the housing member is cylindrical and has an opening in a part thereof in a circumferential direction, the opening receiving the connector portion.

5. The fuel injection valve according to claim 1, wherein a load is applied to the second end of the housing member.

6. A fuel injection valve comprising:

a body having a nozzle hole;

a valve member for selectively enabling fuel to inject through the nozzle hole;

a coil for generating a magnetic field;

a movable core axially reciprocating with the valve member;

a fixed core provided adjacent to a side of the movable core that is opposite to the nozzle hole, the fixed core and the movable core being attracted to each other and moving with the valve member due to the magnetic field generated from the coil;

a housing member having a first end fixed to the body and a second end axially movable relative to the fixed core, the housing member covering the coil and forming a magnetic circuit together with the body, the movable core, and the fixed core upon the magnetic field being generated by the coil; and a cylindrical member housing the movable core and the fixed core.

7. The fuel injection valve of claim 6, wherein the cylindrical member includes a first magnetic portion, a second magnetic portion, and a non-magnetic portion disposed axially therebetween.

* * * * *